United States Patent [19]

Lasiewicz et al.

[11] 4,089,294

[45] May 16, 1978

[54] TUBE COATING APPARATUS

[75] Inventors: Thaddeus W. Lasiewicz, Park Ridge; Otto Wrabl, Buffalo Grove; Donald J. Oddo, Rolling Meadows, all of Ill.

[73] Assignee: Fox Valley Corporation, Appleton, Wis.

[21] Appl. No.: 675,221

[22] Filed: Apr. 8, 1976

[51] Int. Cl.[2] ..... B05C 1/02; B05C 13/02

[52] U.S. Cl. ..... 118/230; 118/232; 118/262; 118/503

[58] Field of Search ..... 118/230, 232, 233, 503, 118/262

[56] References Cited

U.S. PATENT DOCUMENTS

| | | | |
|---|---|---|---|
| 1,461,761 | 7/1923 | Paull et al. | 118/230 X |
| 2,015,669 | 10/1935 | Gravely et al. | 118/233 X |
| 2,108,443 | 2/1938 | Prussing | 118/230 X |
| 2,977,925 | 4/1961 | Norton | 118/230 X |

*Primary Examiner*—John P. McIntosh
*Attorney, Agent, or Firm*—Kinzer, Plyer, Dorn & McEachran

[57] ABSTRACT

An apparatus for applying a finish coating of a liquid epoxy containing metallic flakes to the cylindrical exterior surface of tubes such as drawn aluminum tubes. The apparatus includes a carousel which supports six tubes spaced around the periphery thereof with the carousel being rotated about a horizontal axis. A rotable rubber liquid coating applying roll is located below the carousel but offset from directly beneath the rotational axis of the carousel. The liquid epoxy coating is applied to the rubber roll above a metering roll. The carousel is rotated about its horizontal axis to move the tubes into and out of peripheral contact with the liquid coating applying roll, with each tube remaining in contact with the roll through an arc of appoximately 10° of rotation of the carousel. A gear drive rotates each tube while in contact with the liquid coating applying roll in such a manner that the tubes and the liquid coating applying roll move in the same direction and at the same surface speed. Each roll completes several revolutions while in contact with the liquid coating applying roll. The tubes are supported on the carousel by means of holders which are removably mounted on the carousel. The tubes are slipped over the holders and openings are provided in the ends of the holders for the insertion of a tool to remove a tube from a holder after the liquid coating has been applied to the tube. Each holder includes spring biased plates which prevent rotation of a tube relative to the holder.

11 Claims, 7 Drawing Figures

Fig.1.
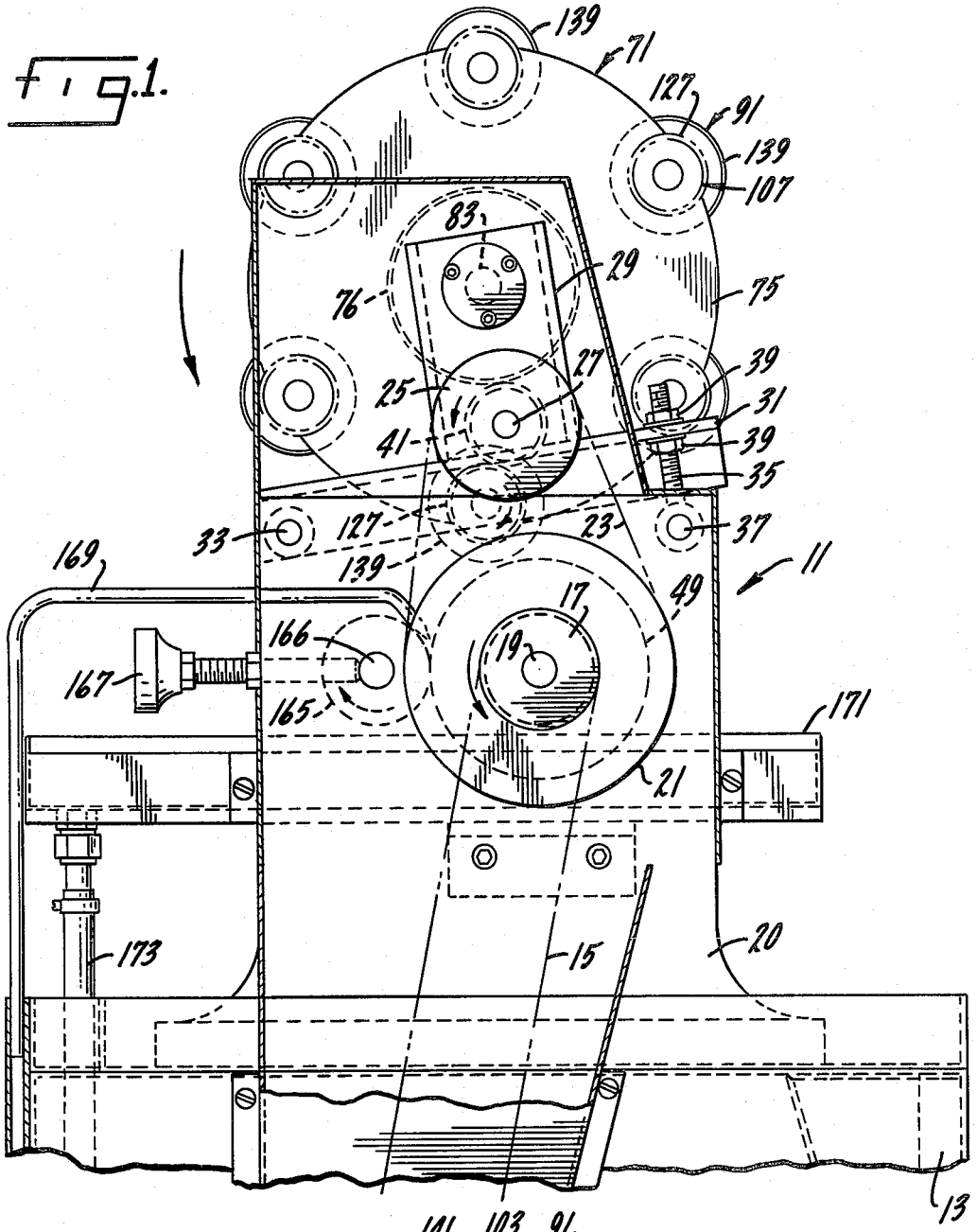
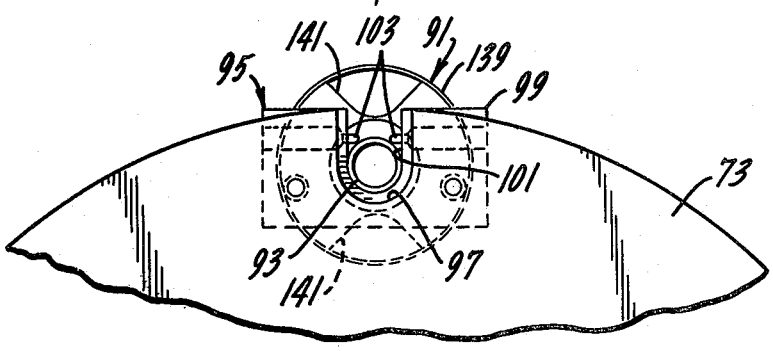
Fig.3.

11
13
15
17
19
20
21
23
25
27
29
33
41
49
51
53
55
57
59
61
65
71
73
75
76
77
79
81
83
85
91
107
127
139
165
166
167
169
171
173

93
137
139
143
151
153
155
157

75
107
109
111
113
115
117
119
123
125
127
129

TUBE COATING APPARATUS

BACKGROUND AND SUMMARY OF THE INVENTION

In recent years, inexpensive substitutes have been sought for brass and brass plated or anodized tubes used for decorative purposes. One substitute has been an aluminum tube coated with an epoxy material containing metallic brass flakes or powder. However, the coating produced on the aluminum tubes using the epoxy and metallic powder mixture has not been entirely satisfactory. The coatings have been afflicted with breakway lines and other imperfections which have rendered the use of such tubes undesirable in applications where the appearance of the tube has been of prime importance. Also, because the coating of the tube was a hand process, it has been both slow and expensive.

Therefore, it is an object of this invention to provide an apparatus which can apply high quality metallic coatings to aluminum tubes both economically and at high output rates.

Another object is such an apparatus that can be adjusted to coat tubes of different diameters.

Another object is a method of quickly loading and unloading tubes relative to the coating apparatus.

Another object is to support thin aluminum tubes in a manner which will prevent collapse of the tubes during coating thereof.

Another object is to permit the safe removal of the coated tubes from their supports after coating without the necessity to wait for the coatings to completely dry.

Other objects may be found in the following specification, claims and drawings.

BRIEF DESCRIPTION OF THE DRAWINGS

The invention is illustrated more or less diagrammatically in the following drawings wherein:

FIG. 1 is a partial end elevational view of the tube coating apparatus of this invention with parts shown in phantom;

FIG. 3 is a partial end elevational view on an enlarged scale of a portion of the apparatus of FIG. 1;

DESCRIPTION OF THE PREFERRED EMBODIMENT

Figure 2:
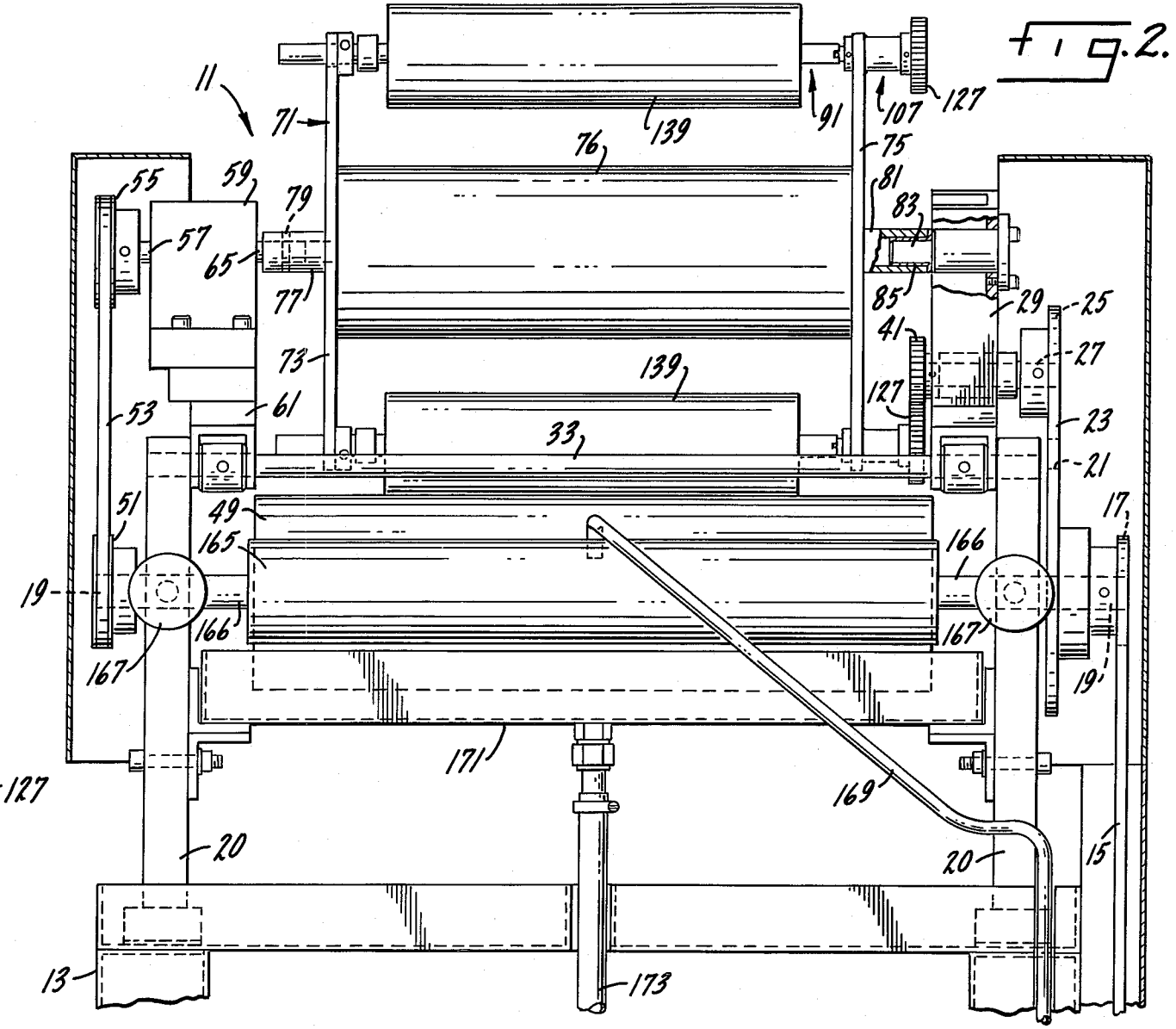
FIG. 2 is a partial side elevational view of the apparatus of FIG. 1 with some parts broken away.

A tube coating machine 11 embodying the novel aspects of this invention is depicted in the drawings. FIGS. 1 and 2 show the upper portion of the machine. The machine includes a base 13 which houses a combination electric drive motor and speed reducer which drive a sprocket (not shown) at a predetermined rotational speed, which in this embodiment is a speed of 56 revolutions per minute. The sprocket meshes with and drives a chain 15. The chain 15 drives sprocket 17 in a counterclockwise direction, as viewed in FIG. 1, at a rotational speed of 56 revolutions per minute. The sprocket 17 is keyed to a shaft 19 which extends transversely of the machine and is supported on walls 20 located at opposite ends of the machine. The walls 20 are supported on the base 13. A larger sprocket 21 is fastened to the shaft 19 just inside sprocket 17. A chain 23 connects sprocket 21 with a smaller sprocket 25 mounted on a shaft 27. Shaft 27 is journalled on a support 29 and is located above the sprocket 21. The support 29 is mounted on an arm 31 which pivots about a shaft 33 supported on and extending between the walls 20.

A threaded rod 35 is pivotally connected at 37 to a side wall 20 and extends through an elongated opening (not shown) in the arm 31. Adjustment nuts 39 thread on the rod 35 and engage the top and bottom of the arm 31 for adjustment of the arm in various positions of rotation relative to its pivotal shaft 33.

The shaft 27 extends inwardly of its support 29. A spur gear 41 is affixed to the end of this shaft located just inwardly of the support 29. A large diameter rubber roll 49 is affixed to the shaft 19 and is located between the side walls 20 of the tube coating machine. The roll 49 is the liquid coating applying roll. The diameter of the rubber roll may vary but it will normally be less than the diameter of the sprocket 21. The rubber used in the roll may be of different compositions depending upon operating conditions but a rubber having a shore A Durometer hardness of 60 has been found to function satisfactorily.

A sprocket 51 is mounted on and affixed to the end of the shaft 19 opposite to the end supporting the sprocket 17. The sprocket 51 drives a chain 53 which in turn drives a similar sprocket 55 affixed to a shaft 57 located above the shaft 19. The shaft 57 is the input of a speed reducing gear assembly 59 which is supported on arm 61 which pivots on the cross shaft 33.

The speed reducing gear assembly 59 has a reduction ratio of 100–1. Thus, the input of the shaft 57 which is 56 revolutions per minute is reduced to an output of 0.56 revolutions per minute at output stub shaft 65. A carousel 71 is connected to and rotated by the stub shaft 65. The carousel includes circular end walls 73 and 75 mounted on opposite ends of a cylindrical tube 76. A sleeve 77 centered on the end wall 73 slides over and receives the stub shaft 65. The sleeve 77 is rotatably connected to the stub shaft 65 by a pin 79. A sleeve 81 centrally located on the opposite end wall 75 of the carousel fits over and is journalled on a stub shaft 83 mounted on the support 29. A bearing 85 is positioned between the sleeve and the stub shaft.

As is most clearly shown in FIG. 1, the shaft 83 defining the rotational axis of the carousel 71 and the shaft 27 which drives spur gear 41 are offset horizontally from each other when the arms 31 and 61 are tilted from the horizontal about their pivotal shaft 33. The shafts 83 and 27 are also offset horizontally from the shaft 19 on which the liquid coating applying roll 49 is mounted.

A plurality of tube holders 91 are mounted around the periphery of the carousel 71. In this embodiment of the invention, six tube holders are provided on the carousel and are spaced 60° apart around the periphery of the end walls 73 and 75. Of course, it should be understood that a greater or lesser number of tube holders may be provided. Each tube holder includes a tubular shaft 93 which is removably supported on the carousel. Shaft support means 95 (FIG. 3) are formed in the end wall 73 and are spaced apart 60° around the periphery of the end wall. Each shaft support means 95 includes a slot 97 formed in the wall 73. Attached to the wall 73 inwardly of each slot is a nylon rectangular bearing plate 99 having a slot 10 formed therein which is similar to but smaller than the slot 97. The slots 97 and 101 are aligned with each other. Spring biased retaining pins 103 are mounted in the plate and extend into the slot 101 to releasably retain a tube holder shaft 93 in the slot 101. A stop collar 105 mounted on the shaft 93 is positioned inwardly of the plate 99 when the shaft is seated in the slot 101 of the bearing plate.

Figure 6:
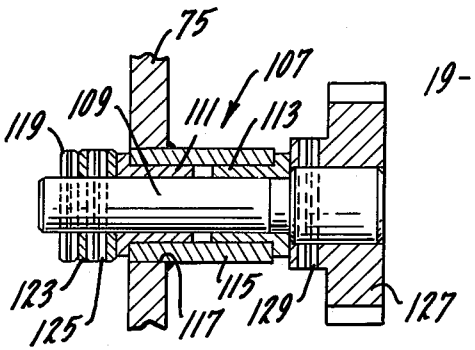
FIG. 6 is an enlarged partial cross sectional view of a tube support drive gear mechanism.

A plurality of tube holder shaft drive means corresponding to the number of tube holders 91 supported on the carousel are mounted on the end wall 75 in alignment with the shaft support means 95. As shown in detail in FIG. 6 of the drawings, each shaft drive means 107 includes a stub shaft 109 journalled in sleeve bearings 111 and 113 which are seated in a tube 115. The tube 115 extends through an opening 117 formed in the carousel end wall 75 and is welded to the end wall.

A pin 119 fastened to one end of the stub shaft 109 seats in diametrically located slots 121 (FIG. 4) formed in the one end of the tube holder shaft 93 to rotate the tube holder shaft. A spacing collar 123 is positioned between the pin 119 and the sleeve bearing 111 and is held to the shaft by a pin 125. A spur gear 127 is attached to the opposite end of the stub shaft 109 by a locking pin 129. The spur gears 127 move in and out of engagement with the driven spur gear 41 during rotation of the carousel 71. When a spur gear 127 of a tube holder 91 engages the driven spur gear 41, the tube holder is rotated at the same rotational speed as the spur gear 41.

Figure 5:
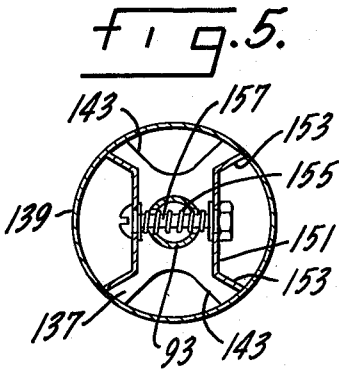
FIG. 5 is a cross sectional view taken along line 5—5 of FIG. 4.
Figure 4:
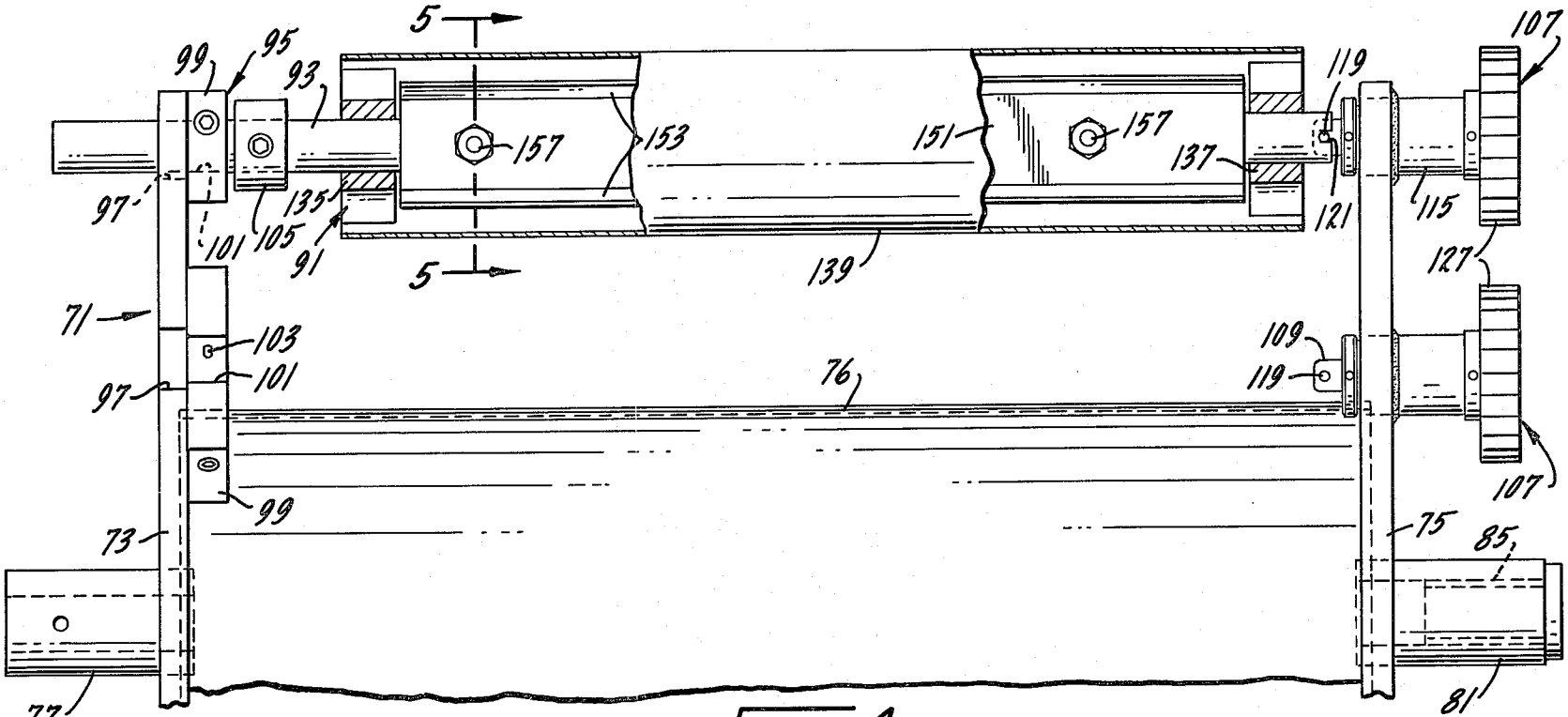
FIG. 4 is an enlarged partial side elevational view of the tube supports mechanism of the apparatus of FIG. 1 with parts broken away for clarity of illustration.
Figure 7:
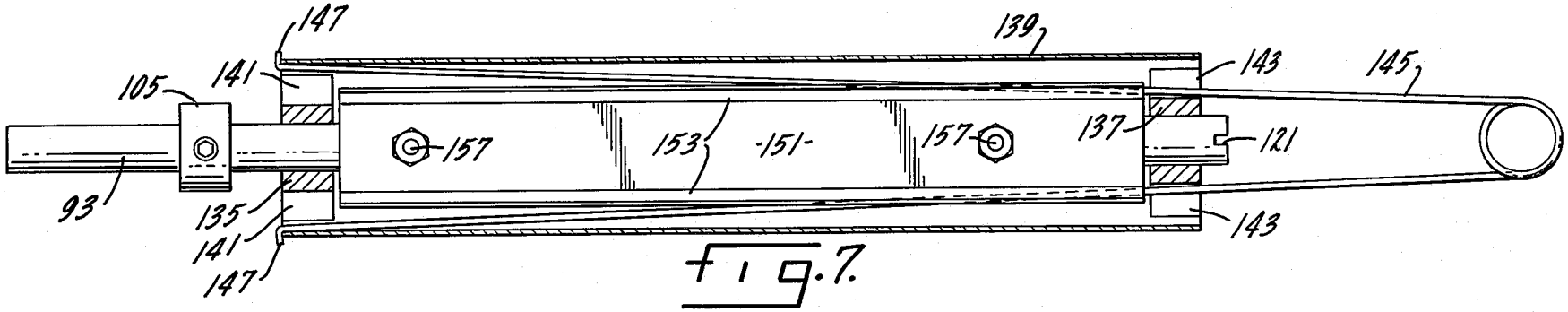
FIG. 7 is a cross sectional view of a tube holder showing a tool for removing the tube from the tube holder.

Referring now to FIGS. 4, 5 and 7 of the drawings, each tube holder 91 includes discs 135 and 137 spaced apart along the shaft 93 a distance equal generally the length of the tube 139 intended to be supported on the tube holder. The tubes are preferably formed of thin drawn aluminum but other suitable materials may be used. The discs have diameters approximately the same as the interior diameter of the tube 139. Diametrically opposed, radially extending and somewhat wedge shaped portions 141 and 143 are removed from the discs 135 and 137, respectively. The cutaway portions 141 and 143 of the discs 135 and 137 are aligned to permit the insertion of a two-legged hanger 145 having outwardly extending hooks 147 at the ends of the legs which hooks engage the end of the tube 139 in the manner shown in FIG. 7 of the drawings. The hanger 145 permits removal of a tube from a tube holder without damaging the finish applied to the tube (not shown) which finish may not be completely dry at the time of removal of the tube from the tube holder.

A pair of pressure plates 151 are mounted on the tube holder shaft 93 and are positioned between the discs 135 and 137. Each pressure plate is of generally U-shaped cross section and has short legs 153 which engage the inside surface of the tube 139. The pressure plates are biased outwardly against the inside surface of the tube 39 by springs 155 which telescope over fasteners 157 which extend through the tube holder shaft 93 and hold the pressure plates on the shaft. The pressure plates 151 and springs 155 are designed so that the pressure plates exert sufficient force against the tube 139 to permit the tube from rotating relative to the tube holder during coating operations but yet permit the tube to be removed from the tube holder by use of the hanger 145. As is most clearly shown in FIG. 5 of the drawings, the pressure plates 151 are located out of alignment with the cutaway portions 141 and 143 of the discs 135 and 137 so as not to interfere with the insertion and removal of the hanger 145 relative to the tube holder.

As shown in FIGS. 1 and 2, a metering roll 165 is mounted on a shaft 166 which is journalled in the walls 20. The metering roll is positioned adjacent the liquid coating application roll 49. Screw adjustment means 167 are provided to adjust the amount of contact between the meter roll 165 and the liquid coating application roll 49. The liquid coating for the tubes 139 flows to the rubber roll 49 and the metering roll 165 through a tube 169. It is supplied by a pump located in the base 13 of the machine and which is not shown. A drip tray 171 is mounted on the side walls 20 beneath the rolls 49 and 165. An overflow tube 173 returns the excess coating liquid to the liquid coating reservoir.

The use, operation and function of this invention is as follows:

When the tube coating machine of this invention is in operation, the carousel 71 is rotating in a couterclockwise direction, as viewed in FIG. 1. In accordance with the preferred embodiment, six tube holders 91 are mounted on the carousel. The carousel is rotating at a speed of 0.56 revolutions per minute which translates into a speed of 108 seconds per revolution of the carousel. The tubes 139 are placed on and removed from the tube holders 91 without stopping rotation of the carousel. Assuming an empty tube holder 91 on the carousel, a tube is installed thereon by first lifting the empty tube holder shaft 93 out of the bearing slot 101. Lifting of one end of the tube holder shaft 93 forces the holding pins 103 inwardly against their springs and released that end of the tube holder shaft. Because the other end of the tube holder shaft is supported on the shaft drive means 107 by a pin and slot connection 119 and 121 respectively, the tube holder can easily be lifted off the carousel. An uncoated tube 139 is then slid over the tube holder from the end having the disc 137. The loaded tube holder is then reinstalled on the carousel by engaging the slots 121 in the shaft 93 with the drive pin 119 of the shaft drive means 107. The opposite end of the shaft is then seated in the bearing support slot 101 where it is retained in position by the spring biased retaining pins 103.

When a tube holder 91 carrying a tube 139 approaches its lowest position of travel on the carousel 71, the spur gear 127 on its shaft drive means 107 engages rotating spur gear 41 which is being driven by the belt 23 through sprocket 25 and shaft 27. Meshing of the spur gears 41 and 127 rotates the tube 139 in a clockwise direction as viewed in FIG. 1 of the drawings. The speed of rotation of the sprocket 127 is pre-selected in accordance with the diameter of the tube 139 so that the peripheral speed of the outer surface of the tube is the same as the peripheral speed of the outer surface of the rubber liquid coating roll 49. During approximately a 10° arc of travel of the tube 139 around the carousel 71, its outer surface will be in contact with the outer surface of the finish applying roll 49. Because of the relative diameters of these rolls, the tube 139 will rotate approximately six times during the 10° arc of travel of the carousel while it is in contact with the liquid applying surface of the rubber roll 49. The liquid epoxy and metallic flake coating will be supplied to the coating roll 49 through the tubing 169. The thickness of the liquid coating applied to the roll 49 is controlled by the metering roll 165 which is rotating in a clockwise direction as viewed in FIG. 1 due to peripheral surface contact with the coating roll 49. The adjusting screws 167 are used to position the meter roll relative to the liquid applying roll 49 and thus to adjust the thickness of the liquid coating carried by the roll 49 to the tube 139. The thickness of the coating applied to the tube may vary from 0.75 mil to 2.0 mils.

The extent of travel of a tube holder during which its tube 139 is contact with the liquid coating applying roll 49 may be varied by tilting the carousel 71 towards or away from the liquid coating applying roll about the pivot shaft 33. This is accomplished by rotating the adjustment nuts 39 to move the arms 31 and 61 along the threaded rods 35. In the preferred adjustment of this machine, the tubes 139 move through an arcuate angle of approximately 10° while in contact with the liquid coating applying roll 49. Also, the coated tube moves out of contact with the liquid coating applying roll on the upward movement of the carousel 71. This helps to eliminate breakaway lines in the coating on the tube.

As a tube holder 91 and its coated tube 139 leave the roll 49 and proceed on their upward movement on the carousel, the tube holder can be removed from carousel by lifting the end of the shaft 93 adjacent the carousel end wall 73. The shaft 93 is lifted out of the bearing slot 101 in the carousel end plate 73. As previously mentioned, the opposite end of the tube holder shaft will release from engagement with the drive pin 119 of the shaft drive means 107.

To remove the coated tube 139 from the tube holder 91 without damaging the coating which may not be completely dry, a two-legged hanger 145 is inserted through the openings 143 in the disc 137 and then slid through the openings 141 in the disc 135 at the opposite end of the tube holder so that the hooks 147 extend outwardly and engage the far end of the tube 139. The two-legged hanger is then pulled to the right as viewed in FIG. 7 to slide the tube off the tube holder. The two-legged hanger 145 may then be used to support the tube during drying operations which usually are carried out in a wick oven.

The tube coating machine 11 of this invention can easily be adjusted to coat tubes of different diameters. Assuming that it is necessary to adjust the machine to coat tubes of a larger diameter, tube holders 91 of the correct size must be provided for the larger diameter tubes. The sprocket 25 and the drive chain 23 must be changed. Tubes of greater diameter require a sprocket 25 having a larger number of teeth and thus a greater diameter. As the diameters of the tubes 139 are increased, the carousel 71 is pivoted about the shaft 33 in a direction away from the liquid coating applying roll 49. The exact positioning of the carousel is accomplished by rotation of the adjusting nuts 39. A chain 23 of the correct length is then reinstalled on the sprockets 21 and 25.

We claim:

1. An apparatus for applying a finish coating to the cylindrical exterior surfaces of thin-walled tubes, said apparatus including:

a carousel having means for supporting a plurality of thin-walled tubes in spaced relation to one another around the periphery of the carousel, said carousel being rotatable about a horizontal axis, a rotatable liquid coating applying roll located adjacent the carousel, means to rotate said liquid coating applying roll at a selected speed, means to apply a measured amount of a liquid coating to said liquid coating applying roll, means to rotate said carousel about said horizontal axis to move the tubes supported on the carousel into and out of peripheral contact with the liquid coating applying roll, and means to rotate said tubes while in peripheral contact with said liquid coating applying roll in a direction and at a rotational speed such that said tubes and said liquid coating applying roll are moving in the same direction and at the same surface speed during peripheral contact, said means for supporting a plurality of thin-walled tubes in spaced relation to one another around the periphery of the carousel including:

end walls at each end of the carousel, a holder for supporting each tube, each holder including a shaft, a drive connection at one end of the shaft, one of said carousel end walls having spaced grooves to receive the shafts of said tube holders, releasable locking means to retain the shafts in the grooves, the other of said carousel end walls having means engaging said shaft drive connection and said means to rotate said tubes.

2. The apparatus of claim 1 in which the shafts of said tube holders are of smaller diameter than the inside wall surfaces of the tubes, tube support discs are attached to said shafts and are spaced apart so as to be located just inside the ends of the tube mounted on the holder, and diametrically spaced, wedge shaped aligned openings are formed in the discs extending inwardly from the peripheries thereof.

3. The apparatus of claim 2 in which longitudinally extending, spring biased pressure plates are positioned between said discs and engage the inner wall surface of the tube to prevent rotation of the tube relative to the holder.

4. The apparatus of claim 3 in which the plates are U-shaped in cross section with the arms of the U's engaging the inner wall surfaces of the tubes.

5. The apparatus of claim 1 in which said carousel is pivotally mounted to be moved in an arc towards and away from said liquid coating applying roll and means are provided to adjust the position of the carousel along the arc relative to the liquid coating applying roll.

6. The apparatus of claim 1 in which the means to apply a measured amount of liquid coating to the liquid coating applying roll includes a metering roll contacting said liquid coating applying roll with both rolls moving downwardly while in contact with each other, said liquid coating being applied to said rolls above their area of contact.

7. The apparatus of claim 1 in which said means to rotate said tubes while the tubes are in contact with the liquid coating applying roll includes a tube holder positioned inside each tube, a shaft formed as part of each tube holder and extending outwardly of the tube, a spur gear connected to the outwardly extending end of said shaft, a drive gear positioned adjacent said liquid coating applying roll, said drive gear meshing with a shaft spur gear as the carousel moves a tube into peripheral contact with the liquid coating applying roll.

8. The apparatus of claim 1 in which the circumference of liquid coating applying roll is at least several times larger than the circumference of a tube and each tube is maintained in peripheral contact with the liquid coating applying roll for at least several complete revolutions of each tube.

9. A holder for supporting a tube during the application of a liquid coating to the exterior surface thereof, said holder including:

a shaft, drive connecting means at one end of the shaft, tube support discs mounted in said shaft in spaced relation to each other with said discs spaced apart a distance not greater than the length of the tube to be supported on the holder, and diametrically spaced, wedge shaped, aligned openings formed in the discs and extending inwardly from the peripheries of the disc.

10. The holder of claim 9 in which longitudinally extending, spring biased pressure plates are positioned between said discs and engage the inner wall surface of the tube to prevent rotation of the tube relative to the holder.

11. The holder of claim 10 in which the plates are U-shaped in cross section with the arms of the U's engaging the inner wall surface of the tubes.

* * * * *